United States Patent [19]

Nohira

[11] Patent Number: 4,696,265

[45] Date of Patent: Sep. 29, 1987

[54] DEVICE FOR VARYING A VALVE TIMING AND LIFT FOR AN INTERNAL COMBUSTION ENGINE

[75] Inventor: Hidetaka Nohira, Mishima, Japan

[73] Assignee: Toyota Jidosha Kabushiki Kaisha, Toyota, Japan

[21] Appl. No.: 813,555

[22] Filed: Dec. 26, 1985

[30] Foreign Application Priority Data

Dec. 27, 1984 [JP] Japan ..... 59-274001

[51] Int. Cl.[4] ..... F01L 1/24; F01L 1/34

[52] U.S. Cl. ..... 123/90.16; 123/90.12; 123/90.55

[58] Field of Search ..... 123/90.16, 90.12, 90.15, 123/90.11, 90.55

[56] References Cited

U.S. PATENT DOCUMENTS

| | | | |
|---|---|---|---|
| 4,218,995 | 8/1980 | Aoyama | 123/90.16 |
| 4,258,671 | 3/1981 | Takizawa et al. | 123/90.16 |
| 4,347,812 | 9/1982 | Kosuda et al. | 123/90.16 |
| 4,408,580 | 10/1983 | Kosuda et al. | 123/90.16 |
| 4,452,187 | 6/1984 | Kosuda et al. | 123/90.16 |
| 4,466,390 | 8/1984 | Babitzka | 123/90.16 |

FOREIGN PATENT DOCUMENTS

| | | |
|---|---|---|
| 54-152307 | 4/1979 | Japan . |
| 54-57009 | 5/1979 | Japan . |
| 55-109711 | 8/1980 | Japan . |
| 58-122713 | 8/1983 | Japan . |
| 58-130005 | 9/1983 | Japan . |
| 58-130006 | 9/1983 | Japan . |
| 58-130045 | 9/1983 | Japan . |

*Primary Examiner*—Ira S. Lazarus

*Attorney, Agent, or Firm*—Cushman, Darby & Cushman

[57] ABSTRACT

A device for varying a valve timing and lift for an internal combustion engine comprises a first valve lifter and a second valve lifter, and an oil pressure chamber being defined between the first valve lifter and the second valve lifter. The flow of oil from the oil pressure chamber is continuously and steplessly controlled through a high-speed response control valve in an oil extraction passage. While the oil is being removed, the valve does not lift. When the high-speed response control valve is closed, the first valve lifter and the second valve lifter move together and the valve begins to lift. By controlling the action of the actuator of the high-speed response control valve, the valve timing and lift of the poppet valve can be controlled to the optimum ones matching the engine operating conditions.

10 Claims, 9 Drawing Figures

DEVICE FOR VARYING A VALVE TIMING AND LIFT FOR AN INTERNAL COMBUSTION ENGINE

BACKGROUND OF THE INVENTION

1. Field of the Invention

The present invention relates to a device for varying a timing and lift of a valve in a reciprocating-type internal combustion engine.

2. Description of the Prior Art

Engine speeds of an internal combustion engine usually vary from about 500 rpm to 6,000 rpm and air volumes taken into the combustion chamber widely vary. In a reciprocating-type internal combustion engine, in which the air volumes taken into the combustion chamber and exhausted from the combustion chamber are controlled by the opening and closing of the intake valve and the exhaust valve respectively, it is necessary to open the intake valve for a longer time in order to take more air into the combustion chamber. Thus, to obtain a high output in a region of high speeds, this valve must be opened for a long time. However, when the intake valve is opened for a long time, the open periods of the intake valve and the exhaust valve increasingly overlap each other and the exhaust gas increasingly exits to the intake port, especially in a range of low speeds, thereby reducing the engine output.

Generally, in a range of low speeds, particularly in a range near idling, the open periods of the intake valve. In fact, the exhaust valve are not required to be long and long open periods of the valves will destabilize the engine speed. In order to optimize the air intake and exhaust timings, it is necessary to control the valve timing and lift with respect to engine operating conditions which vary from moment to moment. This is the reason why a device for varying a valve timing and lift is required.

In a gasoline engine, unlike a diesel engine, a throttle valve is provided in the intake path, and the engine may operate at partial capacity by throttling the air supply with the throttle valve. Since there is an intake pressure loss due to throttling, the fuel efficiency of the gasoline engine is not as high as that of a diesel engine. However, if the throttle function is performed by the intake valve in the gasoline engine, that is, if the lift of the intake valve is controlled corresponding to engine loads and the throttle pressure loss at the throttle valve is eliminated, fuel efficiency and engine output will be improved to a great extent. This is another reason why a device for varying a valve timing and lift for an internal combustion engine is required.

In order to satisfy the above requirements, various devices for varying a valve timing and lift have been proposed. Also, similar techniques to make the intake valve operable or not operable, thereby changing the number of the operating cylinders, have been proposed. For example, Japanese Utility Model Publication No. SHO 55-152307 discloses that the tappet length should be changed between high speeds and low speeds, thereby changing the valve timing. Japanese Utility Model Publication No. SHO 58-122713 teaches supplying either only oil to the oil pressure chamber of the tappet or both oil and air to the oil pressure chamber to vary the valve lift. Japanese Utility Model Publication No. SHO 58-130005, Japanese Utility Model Publication No. SHO 58-130006 and Japanese Utility Model Publication No. SHO 58-130045 disclose diverting a portion of the oil to the oil pan without being supplied to the oil pressure chamber by means of a solenoid valve, thereby changing the valve timing. In addition, Japanese Patent Publication No. SHO 55-109711 and Japanese Patent Publication No. SHO 54-57009 provide similar teachings.

However, any one of the above publications discloses no more than a binary change in valve timing and lift from one state at low speeds to another state at high speeds. The prior art did not control valve timing and lift continuously, corresponding to the continuous range of intermediate engine speeds and loads. Thus, a finer control of the valve timing and lift has been demanded to improve the engine performance, specifically the output and the fuel efficiency of the engine.

SUMMARY OF THE INVENTION

An object of the present invention is to improve engine performance, specifically to achieve a higher output and a higher fuel efficiency of an engine, by making it possible to operate the engine with no throttle valve thereby reducing the pressure loss at the throttle valve, and by making both the valve timing and the valve lift continuously variable thereby enabling the engine to operate in accordance with the engine operating conditions.

A device for varying valve timing and lift for an internal combustion engine according to the present invention comprises a first valve lifter of a poppet valve, a second valve lifter provided between the first valve lifter and a cam, and an oil pressure chamber defined by the first valve lifter and the second valve lifter. An oil supply path supplies a pressurized oil into the oil pressure chamber and fills the oil pressure chamber with oil. An oil extract path directs the oil from the oil pressure chamber. A high-speed response control valve is provided on the oil extract path. The high-speed response control valve can continuously direct the oil from the oil pressure chamber during a specified period after the start of the cam lift operation so as to continuously control the volume of the oil pressure chamber and to continuously control valve timing and lift corresponding to engine operating conditions.

In the above device, valve timing and valve lift are varied by controlling the amount of oil passing through the high-speed response control valve from the oil pressure chamber into which oil under a constant pressure has been supplied. When the high-speed response control valve is closed, the volume of the oil pressure chamber is unvariable. Therefore, the first valve lifter and the second valve lifter are interlocked each other and the both lifters move up and down together. To the contrary, when the high-speed control valve is opened, even if the second valve lifter is drived downward after the start of the cam lift operation, only the volume of the oil pressure chamber decreases and the first valve lifter does not move downward, and therefore the poppet valve does not lift. When the high-speed response control valve is again closed at a specified period after the start of the cam lift operation, the volume of the oil pressure chamber again becomes unvariable. The first valve lifter and the second valve lifter again move downward together and the valve will open. The valve timing and the valve lift can be controlled continuously and match the engine operating conditions by controlling the specified period, during which the high-speed response control valve operates after the start of the cam lift operation, corresponding to the engine operating conditions at every opening and closing of the valve.

When an electrostriction-type movable valve utilizing a piezo element is used for the high-speed response control valve, since the piezo element can respond at a frequency over 1 KHz and ON-OFF operation at a 100 micro-second period is possible, the electrostriction-type movable valve can achieve the necessary high-frequency control during the specified period after the start of the cam lift operation. Moreover, the response time of a high-speed solenoid operated valve, such as is used for fuel injection, is about 1 milli-second and therefore, such a high-speed solenoid operated valve can also be used for the high-speed response control valve under some engine operating conditions.

The control of such high-speed response control valve can be performed by controlling the number of pulses or modulating the pattern of pulses.

BRIEF DESCRIPTION OF THE DRAWINGS

These and other objects and advantages of the invention will become more apparent and more readily appreciated from the following detailed description of the presently preferred exemplary embodiment of the invention taken in conjunction with the accompanying drawings, of which.

DETAILED DESCRIPTION OF THE PREFERRED EMBODIMENTS

Figure 1:
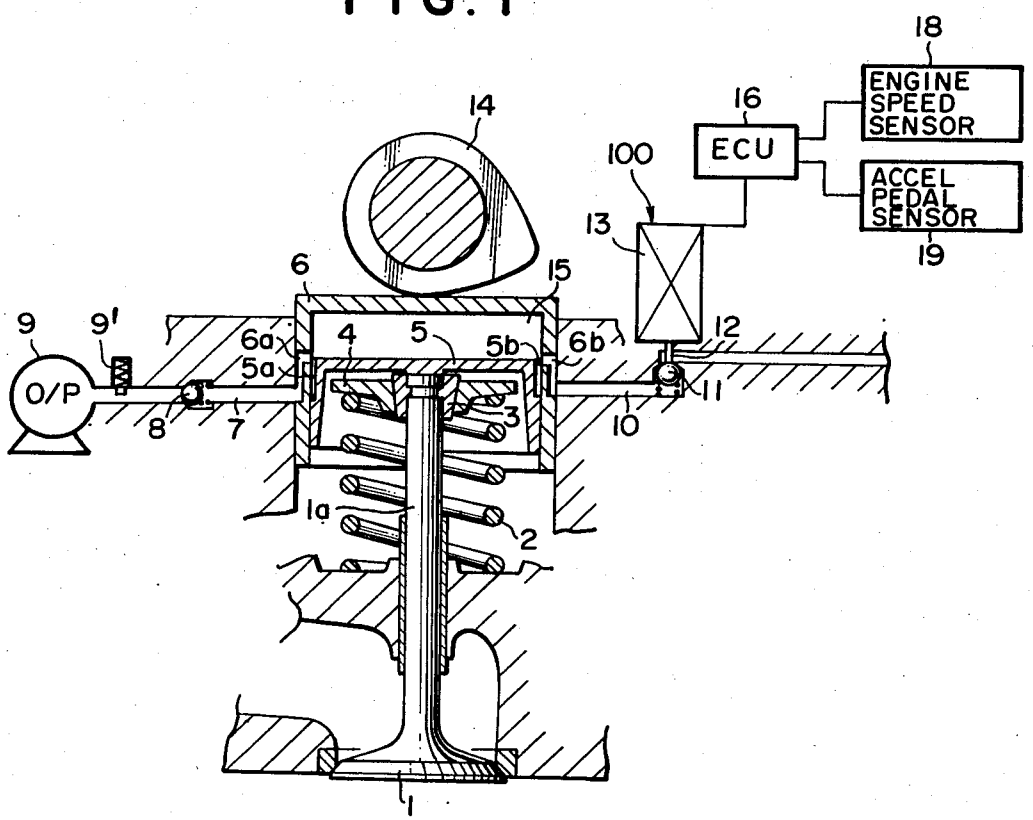
FIG. 1 is a sectional view of a device for varying valve timing and lift for an internal combustion engine according to a first embodiment of the present invention.

FIG. 1 shows a device for varying a valve timing and lift for an internal combustion engine according to a first embodiment of the present invention. A poppet valve 1 is pushed upward by a valve spring 2 so as to close an intake port or an exhaust port. The top of a valve stem 1*a* of poppet valve 1 is coupled to a retainer 4 via a cotter 3 and valve spring 2 pushes retainer 4 upward. A first valve lifter 5 is provided at the top end of poppet valve 1. Valve lifter 5 contacts poppet valve 1 and transmits valve opening and closing loads.

First valve lifter 5 comprises a cylinder having a closed end. A cam 14 is arranged above first valve lifter 5. Between first valve lifter 5 and cam 14 is provided a second valve lifter 6. Second valve lifter 6 comprises a cylinder having a closed end and contacts cam 14 at the upper surface of the closed end. The inner surface of the cylinder of second valve lifter 6 slidably contacts the outer surface of the cylinder of first valve lifter 5. First valve lifter 5 and second valve lifter 6 define an oil pressure chamber 15, formed within the cylinder of second valve lifter 6 and between the closed end of second valve lifter 6 and the closed end of first valve lifter 5. The volume of oil pressure chamber 15 is determined by the positional relationship between first valve lifter 5 and second valve lifter 6.

An oil supply path 7 is connected to oil pressure chamber 15 and pressurized oil from an oil pump 9 is supplied to oil pressure chamber 15 through oil supply path 7. An inlet check valve 8, in oil supply path 7, allows oil to flow only in the direction from oil pump 9 to oil pressure chamber 15. An oil pressure regulator 9', between inlet check valve 8 and oil pump 9, regulates the pressure of the oil sent from oil pump 9 to oil pressure chamber 15. Oil supply path 7 connects with oil pressure chamber 15 through an oil hole 6*a* provided in the cylinder of second valve lifter 6 and an oil groove 5*a* provided at the outer surface of the cylinder of first valve lifter 5.

Further, an oil extract path 10 is connected to oil pressure chamber 15 through an oil hole 6*b* provided in the cylinder of second valve lifter 6 and an oil groove 5*b* provided at the outer surface of first valve lifter 5. An exit check valve 11, in oil extract path 10, allows oil to flow only in the direction from oil pressure chamber 15 to an oil pan (not shown). A check ball of exit check valve 11 contacts a valve needle 12 of a high-speed actuator 13 so that exit check valve 11 can be opened by the movement of valve needle 12 as controlled by high-speed actuator 13. A high-speed response control valve 100 comprises exit check valve 11, valve needle 12 and high-speed actuator 13.

High-speed response control valve 100 may comprise an electrostriction-type movable valve utilizing a piezo element or may comprise a high-speed solenoid operated valve such as one used as a fuel injection valve for an internal combustion engine. In the present invention, "high-speed" means the speed in which check valve 11 can be opened or closed so as to control freely the valve timing and lift for every valve lift in a range of high speeds of an engine, usually in a range of 6,000 rpm. Since the response frequency of an electrostriction actuator utilizing a piezo element is over 1 KHz, a high-speed response control valve driven by such an actuator can be turned on or off in 100 micro-seconds and can be used for high speed response control valve 100 of the present invention. A high-speed solenoid operated valve can be turned on or off in 1 milli-second and can be used for high-speed response control valve 100 of the present invention under some engine operating conditions.

Figure 2:
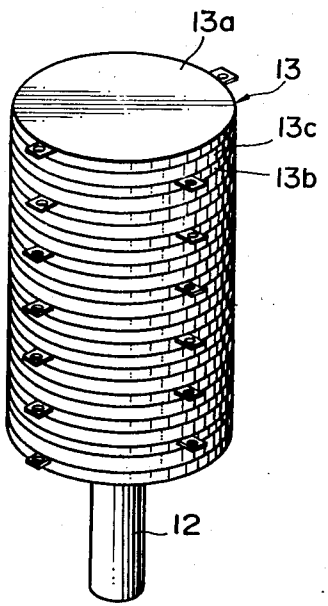
FIG. 2 is a perspective view of a piezo element of a high-speed response control valve used in the device according to the present invention.

FIG. 2 shows actuator 13 of electrostriction-type high-speed response control valve 100. Actuator 13 comprises a plurality of piezo elements 13*a* of ceramic and electrodes 13*b* and 13*c* provided at opposite ends of each piezo element 13. The piezo elements 13*a* and electrodes 13*b* and 13*c* are stacked in series and electrodes 13*b* and 13*c* are electrically connected in parallel. When an electric voltage is applied across piezo elements 13*a*, a distortion is produced. The sum of the distortions of piezo elements 13*a* is the driving stroke of actuator 13 to move check valve 11 and open it via valve needle 12.

High-speed response control valve 100 is controlled by controlling the number of electric pulses applied on actuator 13 or modulating the pattern of the pulses such as pulse width modulation.

High-speed response control valve 100 is electrically connected to an electric control unit (ECU) 16. ECU 16 is electrically connected to an crank angle sensor 17, engine speed sensor 18, accelerator pedal sensor 19 and compression top dead center sensor 20, and if necessary, is connected to various engine operating condition detecting sensors such as an engine cooling water temperature sensor. ECU 16 receives electrical signals from the above-mentioned sensors. The output signal of ECU 16 is sent to actuator 13 of high-speed response control valve 100 which is electrically connected to ECU 16. Actuator 13 operates according to the signals from ECU 16.

Figure 3:
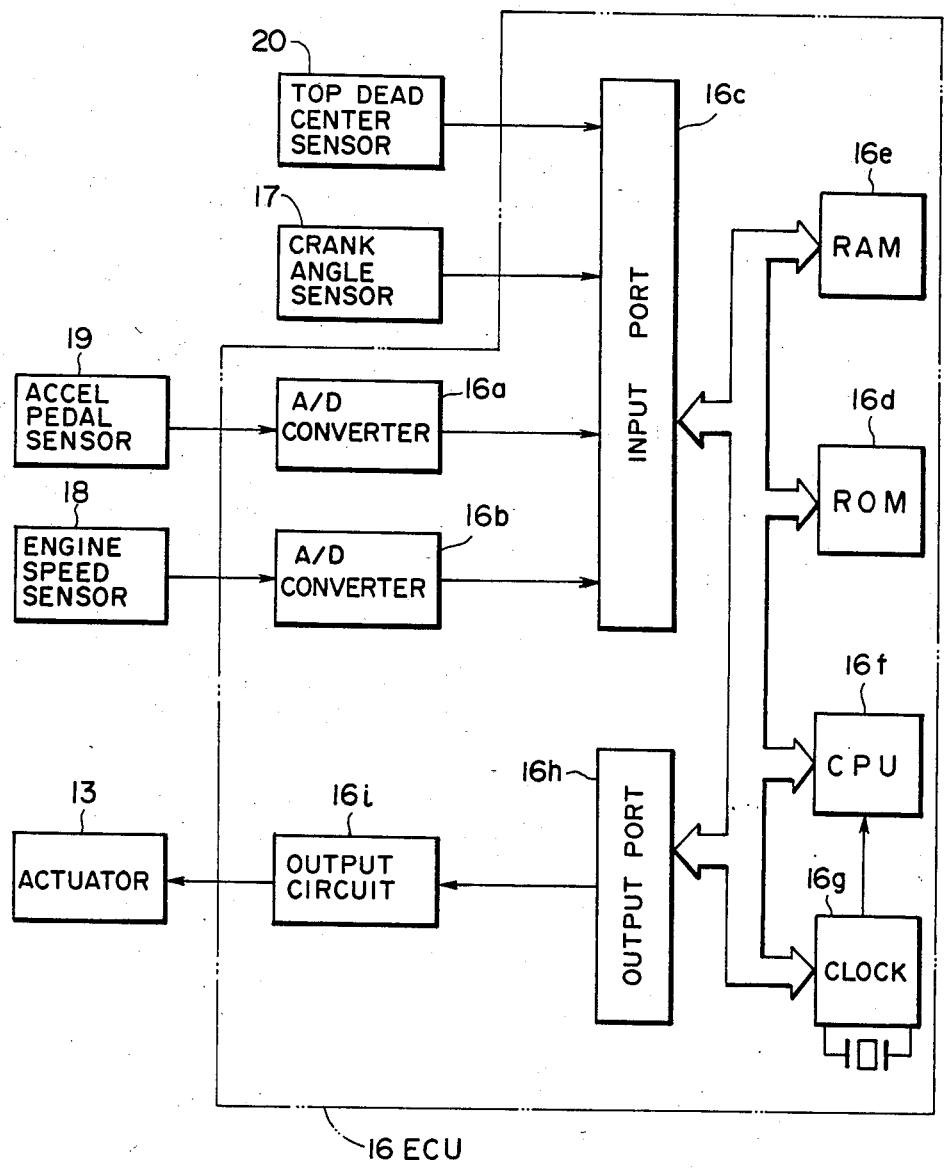
FIG. 3 is a block diagram of an electric control unit (ECU) used in the device according to the present invention.
Figure 4:
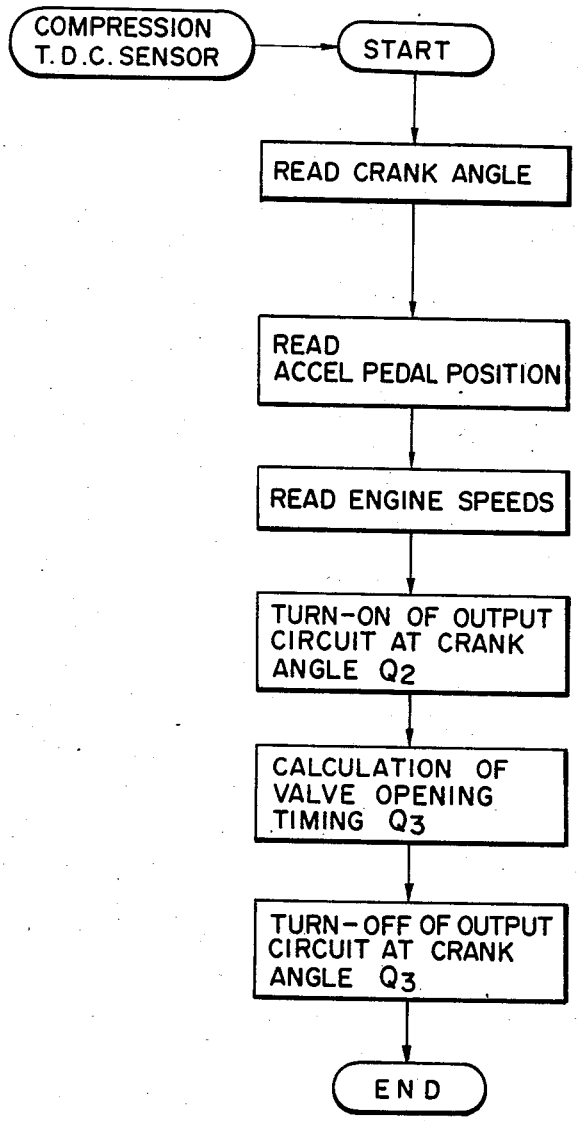
FIG. 4 is a flow chart illustrating the operation of the ECU.

ECU 16 has an internal mechanism shown in FIG. 3 and is operated according to the control flow shown in FIG. 4. ECU 16 comprises analog/digital converters 16*a*, 16*b* . . . for converting the analog signals from engine speed sensor 18 and accelerator pedal sensor 19 to digital signals, an input port 16*c* for directly receiving various signals from various sensors, a control processor unit (CPU) 16*f* for calculating an optimum valve timing and lift matching the engine operating conditions at every valve lift by comparing the signals stored in RAM 16*e*, which temporarily stores the signals from various sensors, with the signals stored in ROM 16*d* indicating the optimum valve timing and lift predetermined for various engine operating conditions, a clock 16*g* which lets CPU 16*f* operate during a predetermined specified time, and an output port 16*h* and an output circuit 16*i* to send the output signals from CPU 16 to actuator 13. Output circuit 16*i* is electrically connected to actuator 13.

As shown in FIG. 4, upon detection of top dead center, ECU 16 reads crank angle, accelerator pedal position (P), engine speed (N) and other engine operating condition parameters, sets output circuit 16*i* to ON when the crank angle comes to $Q_2$, calculates crank angle $Q_3$ of the valve closing timing optimum for the input engine operating conditions, and sets output circuit 16*i* to OFF when the crank angle comes to $Q_3$.

Figure 5:
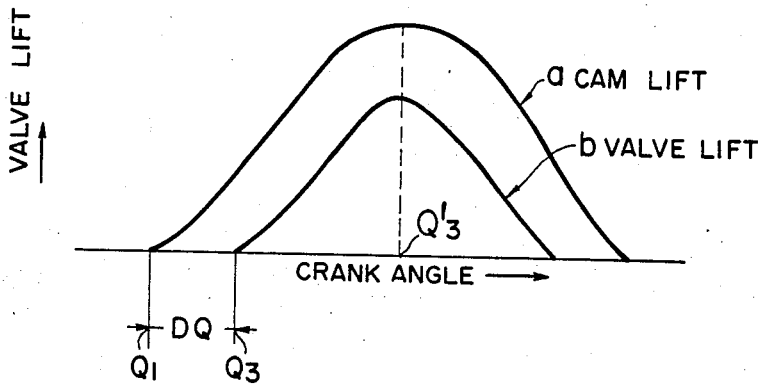
FIG. 5 is a graph showing the valve timing and lift characteristics of the device of FIG. 1.
Figure 6:
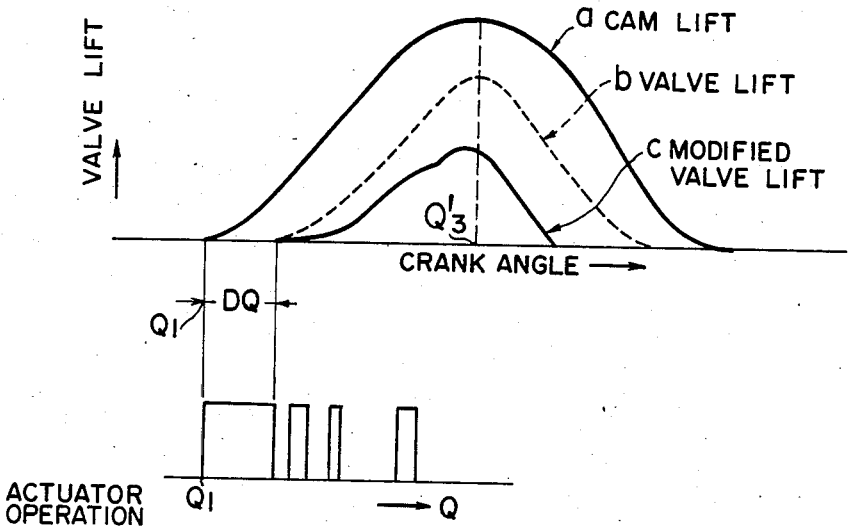
FIG. 6 is a graph showing the valve timing and lift characteristics when the valve is controlled under pulse modulation control.

As shown in FIG. 5, when a crank angle $Q_1$ is reached at which cam 14 begins to press down on second valve lifter 6, high-speed response control valve 100 is open. In FIG. 5, curve a represents the lift provided by cam 14 and curve b represents the actual movement of valve 1. For a first amount, oil in oil pressure chamber 15 decreases through oil path 10, and poppet valve 1 does not lift. When the crank angle comes to $Q_3$, which is delayed from $Q_1$ by an angle DQ, high-speed response control valve 100 is deenergized to close oil path 10. This causes first valve lifter 5 and second valve lifter 6 to move together, and poppet valve 1 begins to lift. The valve timing and the valve lift are controlled by controlling crank angle $Q_3$ at every valve lift. If actuator 13 is operated and high-speed response control valve 100 is opened in the range of crank angles between angle $Q_3$ and the crank angle $Q_3'$ corresponding to the highest lift position of poppet valve 1, the pattern of lift curve of poppet valve 1 varies continuously as shown in FIG. 6 and the valve lift can be controlled freely. Curve c of FIG. 6 shows the valve lift curve when the pulse width of the electric voltage applied across actuator 13 is modulated as illustrated. A conventional mechanism to produce a primary electric current signal for a spark ignition timing control device can be used for the mechanism to produce the above-mentioned electric pulse for actuator 13.

Next, the operation of the device of the first embodiment of the present invention will be described.

Oil pump 9 supplies oil under constant pressure to oil pressure chamber 15 through regulator 9'. The pressure of the oil is regulated such that the valve opening force by the oil pressure does not exceed the valve closing force by valve spring 2.

While actuator 13 is not energized, and accordingly valve needle 12 is not pressing check valve 11, the oil is kept within oil pressure chamber 15. When cam 14 rotates and initiates lifting, oil pressure chamber 15 rigidly reacts to this movements and the movement of second valve lifter 6 by cam 14 directly becomes equal to the movement of poppet valve 1. When actuator 13 receives signals from ECU 16 and acts in an appropriate range of crank angles, valve needle 12 presses exit check valve 11, and the oil in oil pressure chamber 15 can escape. Until the cam lift speed rises to such an extent that the volume displaced by the movement of second lifter 6 comes to exceed the maximum flow rate of oil extract path 10, only the volume of oil pressure chamber 15 varies and poppet valve 1 will not lift. Therefore, the valve timing is controlled. When the volume displaced by the movement of second lifter 6 comes to exceed the maximum flow rate of oil extract path 10, the oil pressure in oil pressure chamber 15 begins to rise and poppet valve 1 begins to lift. When high-speed response control valve 100 is closed by actuator 13, oil pressure chamber 15 becomes rigid and the valve lift becomes equal to the cam lift. The acting period of actuator 13 is predetermined in the design. If the working force of actuator 13, namely the force of the valve needle 12 to push check valve 11, is larger than the oil pressure force acting on outlet check valve 11, the oil can leave oil pressure chamber 15 even during cam lifting, thereby enabling the valve lift control. The lift can be predetermined in design.

Figure 7:
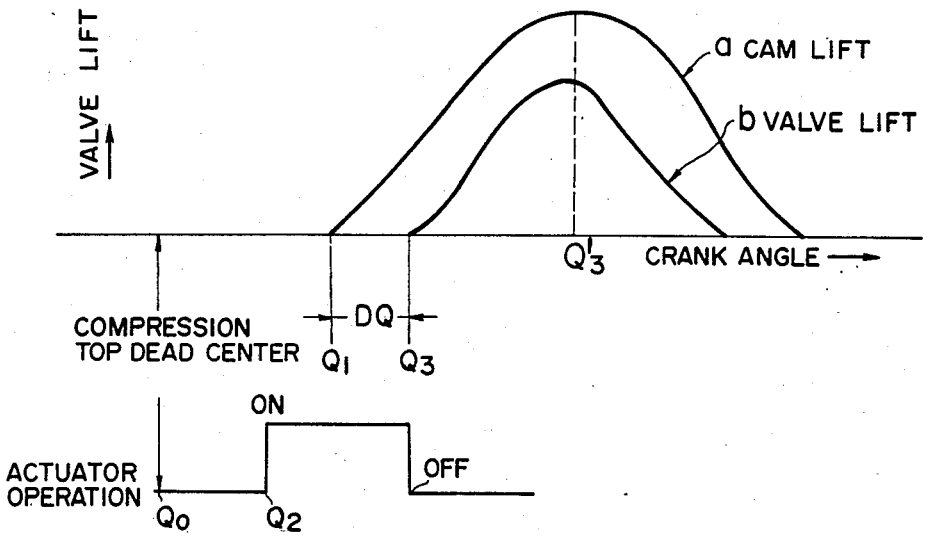
FIG. 7 is a graph showing the relationship between the operation of an actuator and the valve timing and lift characteristics of FIG. 5.

FIG. 7 shows the variance of the valve timing and the valve lift when the volume of oil pressure chamber 15 is varied by energizing actuator 13 to open check valve 11 from crank angle $Q_2$ to crank angle $Q_3$ which is at a specific crank angle DQ from crank angle $Q_1$ of the initial cam lift.

Figure 8:
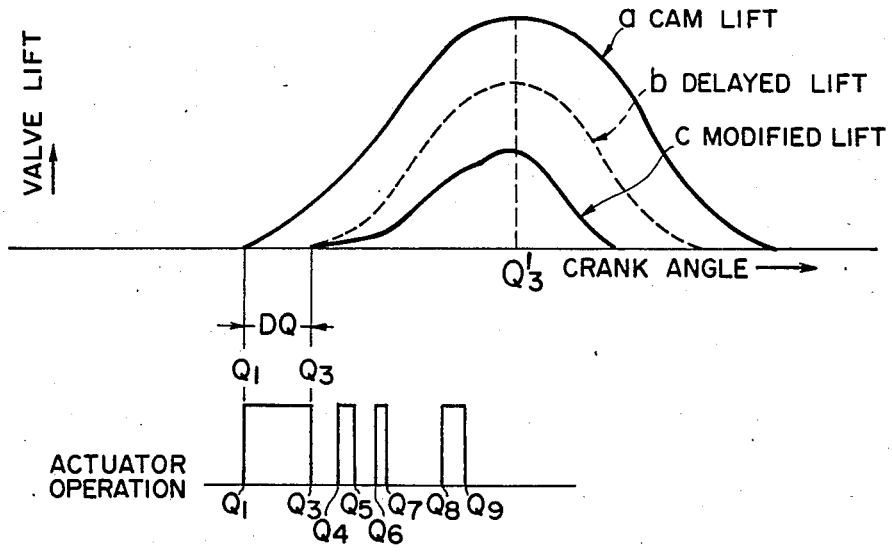
FIG. 8 is a graph showing the relationship between the operation of an actuator and the valve timing and lift characteristics of FIG. 6.

FIG. 8 shows valve timing and valve lift controlled by a pulse modulation signal in which oil pressure is released while the oil pressure in oil pressure chamber 15 is being increased. In FIG. 8, curve a shows conventional cam lift characteristics, curve b shows the cam lift characteristics of delay of a specified crank angle and curve c shows the characteristics in which both a delay of timing and modulation of the lift curve pattern by pulse modulation are given.

According to the above-described control, it is possible to control the valve lift to zero despite the cam lifting by removing oil from oil pressure chamber 15. In the case of a multi-cylinder engine, it is also possible to make a valve of a specific cylinder non-operable, which is often required in a range of partial loads. Further, it will be possible to optimize the relationship between the timings of the intake valve and the exhaust valve including their overlap. The working of actuator 13 can be freely controlled if appropriate logic is incorporated to ECU 16 using various sensors. For instance, it is possible to realize non-throttle operation by making the lift small in idling. In a range of full loads the engine performance will be secured by a normal valve action.

Figure 9:
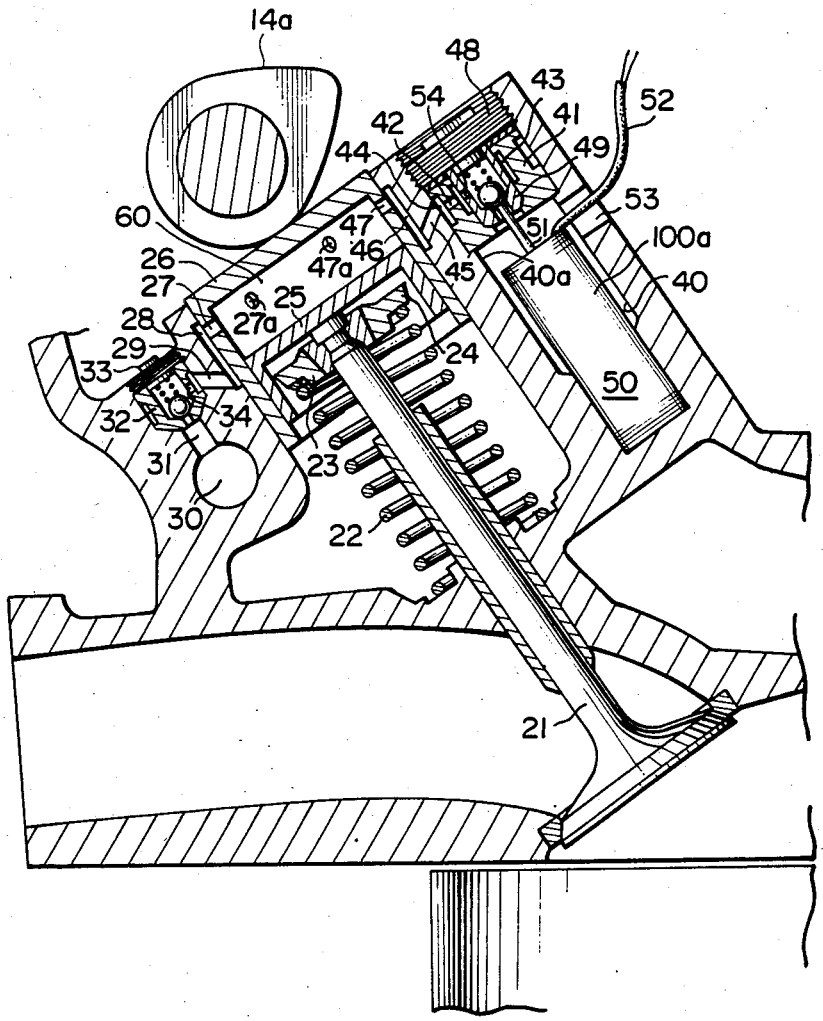
FIG. 9 is a sectional view of a device for varying valve timing and lift for an internal combustion engine according to a second embodiment of the present invention.

FIG. 9 shows a second embodiment of the present invention. The structures of a poppet valve 21, a valve spring 22, a cotter 23 and a spring retainer 24 are the same as in the first embodiment. A first valve lifter 25 and a second valve lifter 26 have no oil groove. A plurality of oil holes 27, 27*a* for supplying oil and oil holes 47, 47*a* for extracting oil are provided in second valve lifter 26. The sizes of holes 27, 27*a*, 47 and 47*a* may be the same. Oil holes 27, 27*a* communicate with a crescent oil groove 28 provided in the cylinder head. Oil groove 28 communicates via a check-ball assembly 33 and oil hole 31 with a main oil hole 30 in the cylinder head. Check-ball assembly 33 is screwed into a screw hole 32 which is coaxial with oil hole 31. Oil can flow from an oil hole 34 provided in check-ball assembly to oil hole 29.

Oil holes 47, 47*a* communicate with a cresent oil groove 46 which is also formed in the cylinder head. Crescent oil groove 46 does not communicate with crescent oil groove 28. Oil groove 46 communicates via an oil hole 45 with recess 40 which is formed in the cylinder head. A piezo element 50 is fitted into recess 40. A lead wire 52 is lead out through an oil escape hole 53. A check valve holder 41 is inserted into recess 40 and a check-ball assembly 49 is housed in check valve holder 41. The top end of check valve assembly 49 juts slightly above the top end of check valve holder 41. The jutting portion of check valve assembly 49 is held by a hole lid 48 which is screwed into recess 40. In this manner, check valve assembly 49 and check valve holder 41 are fixed between hole lid 48 and a stepped portion of recess 40. Oil hole 45 communicates with a circumferentially extending groove 44 provided on the outer surface of check valve holder 41 and groove 44 communicates with a circumferentially extending groove 43 provided on the inner surface of check valve holder 41 via an oil hole 54 provided in check valve assembly 49. Piezo element 50 has a rod 51. When an electric current flows through piezo element 50 and piezo element 50 distorts, rod 51 displaces and pushes the check-ball of check-ball assembly 49. If necessary, the piezo element may be equipped with such a hydraulic mechanism that enlarges the stroke of rod 51. Piezo element 30 and rod 51 constitute a high-speed response control valve 100*a*.

Next, the action of the second embodiment will be described.

When poppet valve 21 is sitting on the valve seat and no oil pressure is acting in oil pressure chamber 60 within second valve lifter 26, oil flows from oil hole 30 via oil hole 31, check valve assembly 33, oil hole 29, crescent oil groove 28, oil hole 27 and oil hole 27*a* into oil pressure chamber 60, and compensates for the oil removed from chamber 60 in the preceding stroke.

When cam 14*a* begins to lift and second valve lifter 26 begins to move downward and an electric current flows through piezo element 50, the oil in oil pressure chamber 60 flows through oil hole 47, oil hole 47*a*, crescent oil groove 46, oil hole 45, oil groove 44, oil hole 42, oil groove 43, oil hole 54, check-ball assembly 49 and oil hole 53. Therefore, first valve lifter 25 does not move downward.

When the electric current ceases to flow in piezo element 50, check-ball assembly 49 closes. Therefore, the oil pressure within oil pressure chamber 60 begins to rise and poppet valve 21 begins to lift.

When the valve lifting is over and poppet valve 21 seats on the valve seat, the state becomes the initial one.

Though second valve lifter 26 rotates around its axis in action, at least one of a plurality of oil holes 27, 27*a*, 47 and 47*a* can communicate with crescent oil grooves 28 and 46. Therefore, the oil flow into and from oil pressure chamber 60 is not disturbed.

The structure and action of ECU described in FIGS. 3 and 4 and the mechanism and function of high-speed response control valve described in FIGS. 5 to 8 can be applied to the second embodiment.

The following effects can be attained by the present invention.

(a) Valve timing and lift can freely be controlled.

(b) The optimum valve timing and lift matching the engine operating conditions can be elected.

(c) Non-throttle control can be obtained by valve lift control and the number of effective cylinders can be changed.

(d) Continuous and stepless control from idling to full loads become possible, thereby increasing engine performance such as engine output and fuel efficiency.

(e) Since the cam lift control allows the cam to be manufactured to have any profile, the manufacture cost can be reduced.

(f) Since the valve timing is directly controlled in the present invention, the control accuracy is increased.

Although only a few exemplary embodiments of the present invention have been described in detail above, those skilled in the art will readily appreciate that many modifications are possible in the exemplary embodiments without materially departing from the novel teachings and advantages of the invention. Accordingly, all such modifications are intended to be included within the scope of the present invention as defined in the following claims.

What is claimed is:

1. A device for varying valve timing and lift comprising:

a first valve lifter movable along an axis and adapted to contact a valve;

a second valve lifter, adapted to contact a cam, movable along ssaid axis, said first and second valve lifters defining a pressure chamber therebetween;

first means for providing a pressure in said pressure chamber, a sole source of pressure to said pressure chamber being by supplying oil to an inlet portion of said pressure chamber; and second means, coupled to an outlet portion different from said inlet portion, of said pressure chamber, for selectively relieving pressure in said pressure chamber; and high speed actuator means for controlling said pressure relieving of said second means, including: check ball valve means for selectively blocking said second means, and actuator means for directly opening said check ball valve means, said check ball valve means disposed so that pressure of said oil closes said check ball valve means.

2. a device for varying valve timing and lift for an internal combustion engine which has a poppet valve and a cam, comprising:

a first valve lifter adapted to contact said poppet valve;

a second valve lifter, provided between said first valve lifter and said cam, said first valve lifter and said second valve lifter defining an oil pressure chamber therebetween which has an inlet portion and an outlet portion;

oil supply path means, coupled to said inlet portion for supplying a pressurized fluid comprising oil into said oil pressure chamber, said pressurized fluid being the only force applied to said chamber;

oil extract path means, coupled to said outlet portion, for extracting said fluid from said oil pressure chamber; and high-speed response control valve means, provided in said oil extract path means, for continuously allowing said fluid to escape from said pressure chamber during a specified period after start of cam lift operation to vary the volume of said oil pressure chamber and for controlling the valve timing and lift corresponding to engine operating conditions, said valve means including a check ball valve disposed so that pressure of said fluid closes said oil extract path means and actuator means for directly opening said check valve against said fluid pressure.

3. The device for varying a valve timing and lift of claim 2, wherein said actuator means comprises an electrostriction-type movable driver.

4. The device for varying a valve timing and lift of claim 2, wherein said actuator means comprises a high-speed solenoid operated driver.

5. The device for varying a valve timing and lift of claim 2, wherein said high-speed response control valve means comprises a valve responsive to a variable pulsed signal and means for generating said variable pulsed signal.

6. The device for varying a valve timing and lift of claim 2, wherein said high-speed response control valve means comprises a valve having operating characteristics corresponding to a variable timing pulse width modulation signal and means for generating said pulse width modulation signal.

7. The device for varying a valve timing and lift of claim 2, wherein said high-speed response control valve means includes electronic control means for: (1) receiving a signal from an accelerator pedal sensor and a signal from an engine speed sensor as its inputs, (2) calculating a valve opening timing and (3) sending its outputs to said actuator means.

8. A method of controlling a valve, comprising the steps of:

transferring motion from a cam to a first valve lifter;

transferring motion from a second valve lifter to said valve;

controlling the volume of a pressure chamber defined between said first and second valve lifters which has independent inlet and outlet paths, by supplying a pressurized oil into said pressure chamber, through said inlet path and selectively commanding a check ball valve in said outlet path to open against said oil pressure, said check ball valve disposed so that said oil pressure would normally close said check ball valve;

selectively opening said check ball valve by transmitting force from an actuator to said check ball valve;

using only said oil pressure as controlled by said check ball valve to apply a force to said second valve lifter.

9. The method of claim 8 wherein said controlling step includes the steps of:

supplying pressure to said chamber; and selectively relieving pressure in said chamber to control the volume thereof.

10. The method of claim 11 wherein said selective relieving step includes the step of alternately relieving pressure and not relieving pressure in a predetermined pattern to control the transfer of motion from said cam to said valve.

* * * * *